United States Patent [19]

Niki

[11] Patent Number: 5,021,825

[45] Date of Patent: Jun. 4, 1991

[54] LATCHING MECHANISM FOR A REMOVABLE PROCESSING CARTRIDGE IN A PHOTOCOPYING DEVICE

[75] Inventor: Hiroshi Niki, Nagano, Japan

[73] Assignee: Seiko Epson Corporation, Tokyo, Japan

[21] Appl. No.: 403,513

[22] Filed: Sep. 6, 1989

Related U.S. Application Data

[63] Continuation-in-part of Ser. No. 57,882, Jun. 2, 1987, Pat. No. 4,868,599.

[30] Foreign Application Priority Data

Jun. 2, 1986 [JP] Japan ..... 61-127806
Sep. 5, 1986 [JP] Japan ..... 61-209316

[51] Int. Cl.[5] ..... G03G 21/00
[52] U.S. Cl. ..... 355/200; 355/210
[58] Field of Search ..... 355/200, 210, 245, 260, 355/296, 298

[56] References Cited

U.S. PATENT DOCUMENTS

| | | | |
|---|---|---|---|
| 3,947,107 | 3/1976 | Smith | 355/260 X |
| 3,985,436 | 10/1976 | Tanaka et al. | 355/200 |
| 4,173,405 | 11/1979 | Swapceinski et al. | 355/260 |
| 4,325,628 | 4/1982 | Torigai et al. | 355/298 X |
| 4,436,414 | 3/1984 | Kamiyama et al. | 355/298 |
| 4,754,293 | 6/1988 | Aizawa et al. | 346/160 |
| 4,757,344 | 7/1988 | Idenawa et al. | 355/260 |

FOREIGN PATENT DOCUMENTS

| | | | |
|---|---|---|---|
| 57-26881 | 2/1982 | Japan | 355/260 |
| 58-14177 | 1/1983 | Japan | 355/298 |
| 58-203479 | 11/1983 | Japan | 355/298 |
| 60-107663 | 6/1985 | Japan | 355/298 |
| 60-254072 | 12/1985 | Japan | 355/298 |
| 62-10684 | 1/1987 | Japan | 355/298 |
| 62-25776 | 2/1987 | Japan | 355/260 |
| 62-98376 | 5/1987 | Japan | 355/260 |
| 62-105176 | 5/1987 | Japan | 355/298 |
| 62-294276 | 12/1987 | Japan | 355/298 |

*Primary Examiner*—Fred L. Braun
*Attorney, Agent, or Firm*—Blum Kaplan

[57] ABSTRACT

In an image forming device, the developing unit, photosensitive drum and/or cleaning unit are assembled into a removable unitary cartridge. A mounting device includes at least one latch for releasably retaining the cartridge on the device through engagement with a projection on the cartridge. The latch includes a camming surface pivotably displaceable by engagement with the projection so as to permit passage of the projection into a notch of the mounting device and returning to a latch position upon such passage.

2 Claims, 14 Drawing Sheets

LATCHING MECHANISM FOR A REMOVABLE PROCESSING CARTRIDGE IN A PHOTOCOPYING DEVICE

BACKGROUND OF THE INVENTION

The application is a continuation-in-part to U.S. Pat. application No. 07/057,882 entitled "Device and Method For Storing Toner Waste," filed June 2,1987, which has issued as U.S. Pat. No. 4,868,599 on Sept. 19, 1989.

This invention relates generally to an image forming apparatus, and especially to a device for collecting toner waste from a photosensitive member of the image forming apparatus. In particular, the application is directed to a unitary cassette, referred to as a process unit, which incorporates a developing device, a photosensitive drum and a cleaning unit.

In an apparatus for forming images using a combination of an electrophotographic process and an optical signal generator, (e.g., a laser beam printer or liquid crystal shutter (LCS) printer), an image is formed on a photosensitive member which is then coated with a toner. A portion of the toner coated image is then transferred to a recording medium. The non-transferred portion of the toner coated image remaining on the photosensitive member (hereinafter referred to as toner waste) is unsuitable for reuse and must be scraped off the photosensitive member and allowed to accumulate within a container.

Toner waste has a tendency to agglomerate. Such agglomeration near the entrance to the container can prevent additional toner waste from being deposited in the container. Toner waste if not deposited in the container, can settle within the apparatus on various components and thus adversely affect and deteriorate performance of the apparatus. It also increases the frequency of removing the container. Having to empty toner waste from the apparatus before the container is full is also undesirable.

In order to circumvent the problem of toner waste agglomeration, toner waste can be deposited into the container using a spiral carrier method disclosed in Japanese Patent Laid-Open Application No. 56-57076. However, the spiral carrier method suffers from the inherent drawback of accumulating toner in a conical pile-like fashion. Consequently, the volume of the container needs to be significantly larger with substantial volume going unused.

One possible solution for overcoming this accumulated conical pile of toner waste is to vibrate or shake the toner waste so as to flatten the pile. However, the oozing and splashing of toner associated with such vibration or shaking as well as noise are undesirable and generally unacceptable.

Another drawback in the prior art relates to the need to alert a user that the container of toner waste needs to be emptied. A proposed solution involves activating a microswitch or other equivalent based on the weight of the toner waste. This solution is considered unreliable. Small amounts of toner waste deposited on the contact points of the microswitch can cause contact failure. Another proposed solution counts the number of revolutions made by the photosensitive member. Generally, each time the photosensitive member completes a revolution approximately 30–40% of the toner coated image is scraped off the photosensitive member and deposited into the container. Therefore, counting the number of completed revolutions of the photosensitive member should presumably indicate when the container is full of toner waste. The exact amount of toner waste is never determined in this latter proposed solution. Therefore, unless an unacceptably low number of revolutions is used as the threshold to trigger the alarm, toner waste can overflow from the container before the alarm is triggered.

Conventional image forming apparatus also splash and/or ooze toner waste from the container following completion of the copying or printing cycle.

Accordingly, it is desirable to provide a cleaning device which overcomes the problems of toner waste agglomeration without having to increase the size of the container. It is also desirable to provide a toner cleaning device which fully utilizes the volumetric interior of the container for storing toner waste and which prevents splashing and oozing of toner waste following completion of the printing or copying cycle. It is also desirable to provide a cleaning device which alerts a user of the need to empty the container before the toner waste overflows and yet is far smaller in size than cleaning devices presently available.

To prevent image quality deterioration, image forming devices using the electro-photographic method require periodic replacement of the photosensitive drum, developing device, and cleaning unit. The image quality deteriorates when the performance of one or more of these devices degrade. The electrostatic properties of the photosensitive drum may degrade due to light, heat, ozone, scratching caused by the cleaning blade, or adhesion of the resin component of the toner to the surface of the drum. Degradation of the developing device occurs when the abrasive properties of the toner cause scratches on the toner carrier or when the resin component of the toner adheres to the carrier. As a result, the electric charge delivered to the toner is unstable resulting in toner blushing. The cleaning unit degrades when the cleaning blade is permanently deformed or deflected, or when the toner waste container is full.

In conventional image forming devices, the photosensitive drum, developing device, and cleaning unit are provided as independent units within the device body. Replacing any of these units requires a service technician with expert knowledge. Besides the expense associated with this service, the user incurs the additional expense associated with his inability to use the device until service is performed. With the proliferation of image forming devices such as compact copy machines, printers, and facsimile machines, to users without expert knowledge, maintenance which can be easily performed by the user becomes of prime importance.

Accordingly, it is desirable to provide a unitary cassette which incorporates a developing device, photosensitive drum, and cleaning unit. The cassette should be replaced by a user not possessing any expert knowledge. This will allow the image forming apparatus to be used continuously.

SUMMARY OF THE INVENTION

In accordance with the invention, an image forming apparatus includes a replaceable unitary cartridge. The cartridge includes at least two of a developing device, photosensitive member, and cleaning unit. The cartridge can be removed and replaced by users with no expert knowledge. The cleaning unit may include a screw device for transporting and compressing the toner waste and a toner waste box having therein a plurality of toner movement controlling plates spaced along the length of the screw device. The screw device may include two spiral carriers moving in opposite directions in separate compartments joined by an opening at the end of the first spiral carrier.

Accordingly, it is an object of this invention to provide a cleaning device for an image forming apparatus which more reliably collects toner waste and maintains toner waste within a container.

It is another object of the invention to provide a cleaning device for an image forming apparatus which prevents toner waste agglomeration from impeding the collection of toner waste from the image carrier of the apparatus.

It is a further object of the invention to provide a cleaning device which more efficiently utilizes the volumetric interior of a container for storing toner waste.

It is still another object of the invention to provide a cleaning device which is more reliable in alerting a user of the need to empty toner waste from a storage container.

It is yet a further object of the invention to provide a cleaning device which reduces the likelihood of toner waste overflowing from a storage container.

It is still a further object of this invention to eliminate the need for separately servicing the photosensitive drum, developing device and cleaning unit.

It is also another object of the invention to enable a user with no expert knowledge to maintain a high level of image quality by facilitating the replacement of the photosensitive drum, developing device and cleaning unit.

Still other objectives and advantages of the invention will in part be obvious and will in part be apparent from the specification.

The invention accordingly comprises several steps and the relation of one or more of such steps with respect to each of the others, and the device embodying features of construction, combination of elements and arrangements of parts which are adapted to effect such steps, are all exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 4(*b*) is a perspective view of the assembled microswitch of FIG. 4(*a*);

FIG. 4(*c*) is a side cross-sectional view of the microswitch taken along the lines c—c of FIG. 4(*b*);

DESCRIPTION OF THE PREFERRED EMBODIMENTS

Figure 1:
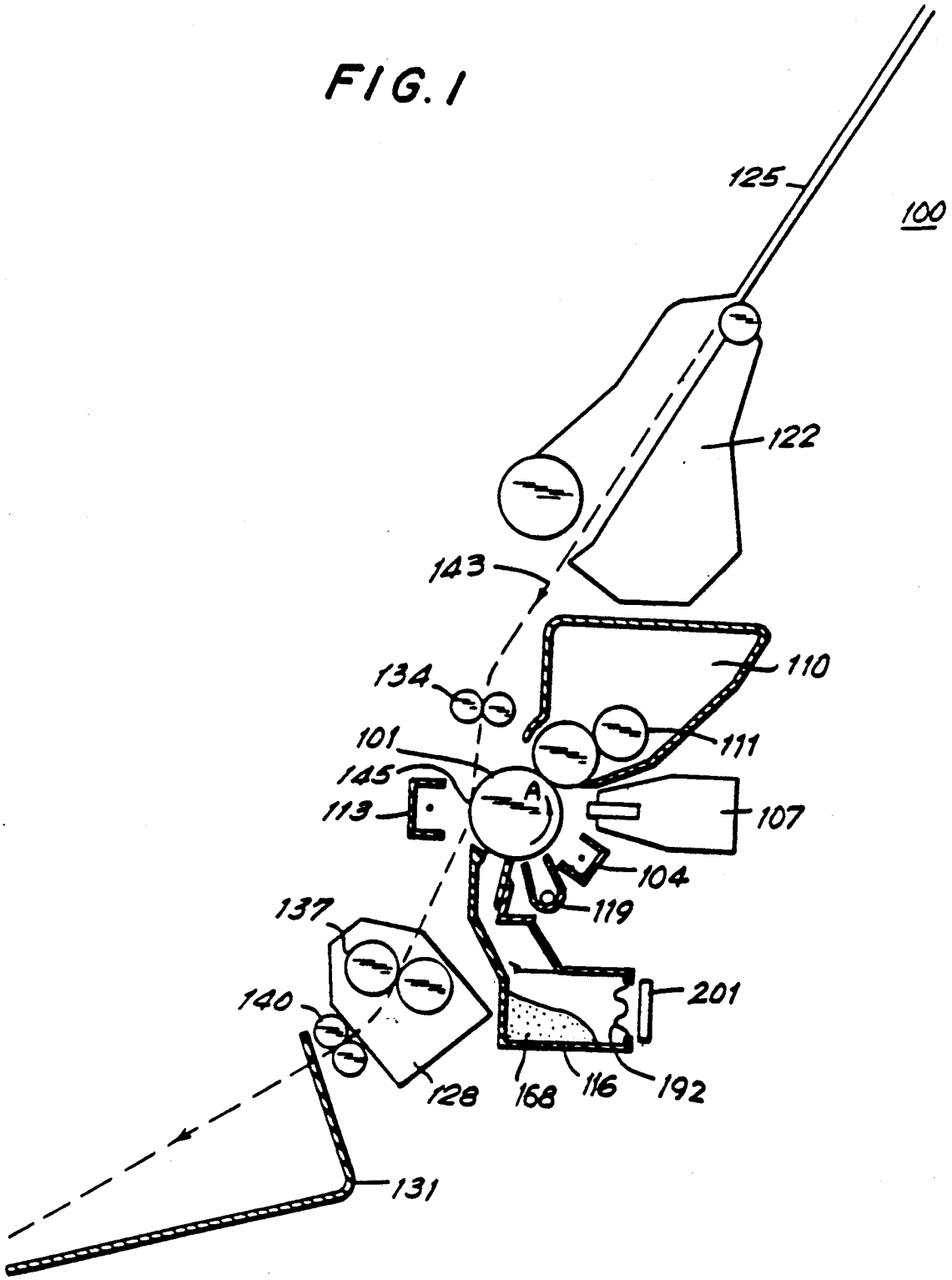
FIG. 1 is a diagrammatic side elevational view in cross-section of an image forming apparatus including a cleaning device showing the paper path in accordance with one embodiment of the invention.

Referring to FIG. 1, a liquid crystal printing apparatus 100 (commonly referred to as a liquid crystal shutter printer) includes a photosensitive drum 101 which serves as an image carrier, a charging device 104, an optical signal generator 107, a developing device 110, a transfer device 113, a cleaning device 116, and an erasing lamp 119. Apparatus 100 also includes a paper stacker 122 for holding paper 125 which serves as the recording medium, a fixing device 128, a delivery tray 131, register rollers 134 and delivery rollers 140. Optical signal generator 107 is positioned behind (i.e. rearwardly) of photosensitive drum 101.

Photosensitive drum 101 is coated with an optical conductive material such as Se, OPC and rotates in the direction of arrow A. Initially, photosensitive drum 101 is uniformly electrically charged, either negatively or positively, by charging device 104. As photosensitive drum 101 continues to rotate in the direction of arrow A, certain areas thereof are irradiated with light in accordance with the image information generated by optical signal generator 107. A static latent image on the surface of drum 101 forms and passes developing device 110. A sleeve 111 of developing device 110 brushes charged toner, which is stored within developing device 110, onto photosensitive drum 101 in accordance with the static latent image charge. At the same time and in synchronism with the static latent image formed on photosensitive drum 101, paper 125 is released from paper stacker 122 and advances in a path (denoted by dash lines 143) past register rollers 134 to a transfer position 145. The toner image which is formed on photosensitive drum 101 is transferred to paper !25 at transfer point 145 by transfer device 113. Thereafter, paper 125 advances along path 143 to fixing device 128 for permanently affixing the toner to paper 125.

Paper 125 advances along path 143 such that path 143 and a line extending from that portion of the surface of photosensitive drum 101 which is in contact with paper 125 passing through the center of photosensitive drum 101 form either an oblique or right (i.e. perpendicular) angle. A simple face down paper delivery system in which paper jamming is minimized results.

Fixing device 128 includes a pair of fixing rollers 137 which are connected to a heating source for heating the toner. When the toner is heated it penetrates paper 125 and fuses to the fibers. When paper 125 advances beyond fixing device 128 the fused toner rapidly cools and becomes permanently affixed to paper 125. Paper 125 is then guided to delivery tray 131 by delivery rollers 140.

After the usage is transferred to paper 128, photosensitive member 101 continues to rotate in the direction A beyond transfer point 145. Excess toner 168 (i.e., toner waste) which has not been transferred onto paper 125, and which typically amounts to about 30–40% of the toner forming the toner image, is removed by cleaning device 116. Thereafter, the entire surface of photosensitive drum 101 is uniformly irradiated with light by erasing lamp 119 and is now ready to be recharged by charging device 104.

Figure 2:
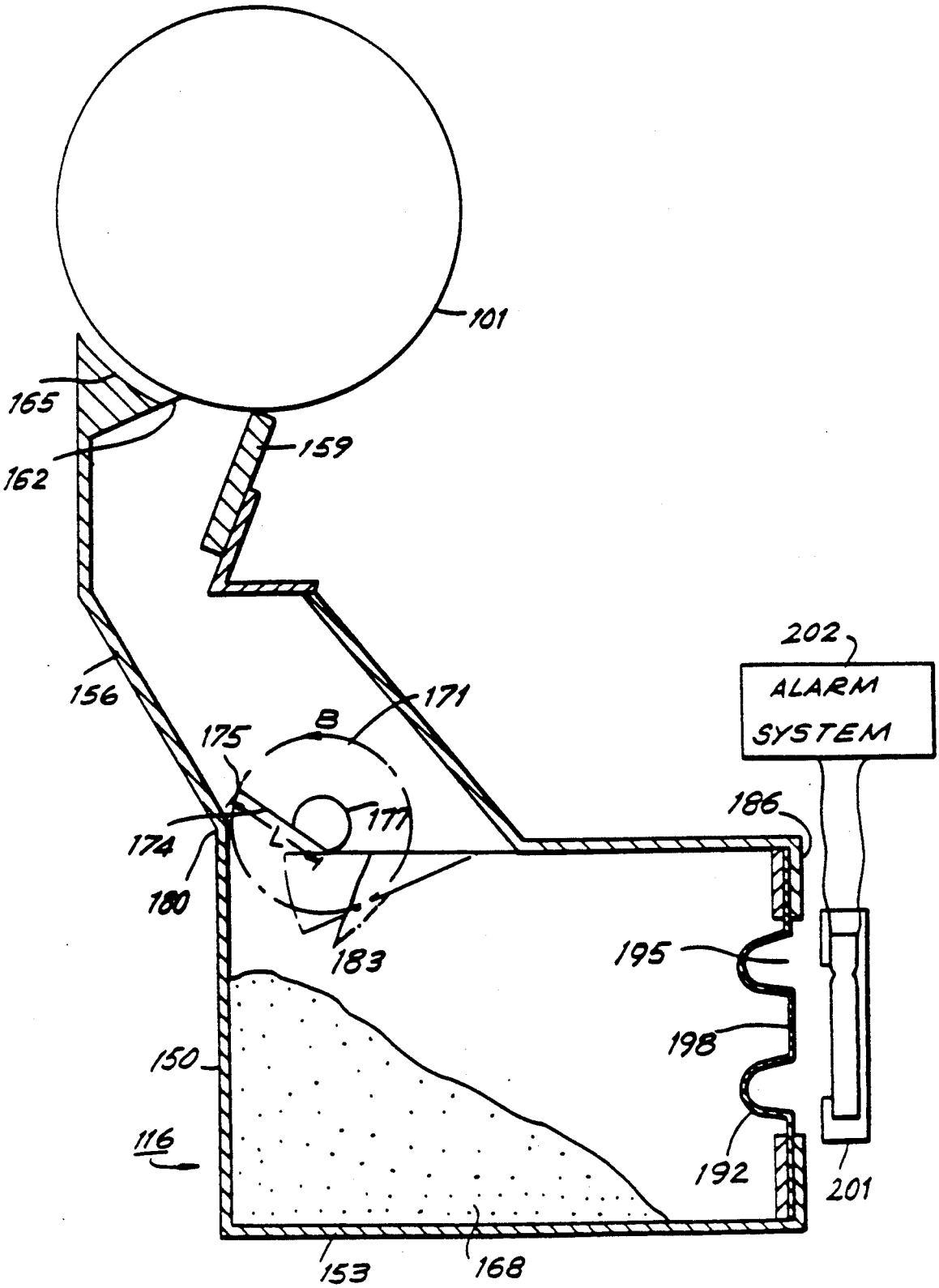
FIG. 2 is a cross-sectional view of a portion of the cleaning device of FIG. 1.

As shown in FIG. 2, cleaning device 116 includes a container 150 (otherwise referred to as a toner box) having a hollow interior with a substantially rectangular box-like base 153 and a crooked tilted inlet stack 156 integrally connected to and rising from a neck 180. Connected to one side of stack 156 at its distal end is a cleaning blade 159 for removal of excess/nontransferred toner which remains on photosensitive drum 101. On the other side of stack 156 at its distal end is a seal member 162 having a substantially triangular shaped cross-section with a side 165 conforming substantially to the curved surface of and extending in the axial direction of photosensitive drum 101. Cleaning blade 159, seal member 162 and photosensitive drum 101 together enclose the top of stack 156 to prevent toner waste 168 from splashing and oozing through stack 156 during and/or after the copying/printing cycle. Seal member 162 is formed with materials such as, but not limited to, PET, Teflon or the like. These materials do not adversely affect the performance of photosensitive drum 101, but minimize adherence of toner waste 168 to the surface of seal member 162.

Cleaning device 116 is positioned below photosensitive drum 101 such that as excess toner 168 is removed from photosensitive drum 101 by cleaning device 116, excess toner 168 falls (i.e. drops) into container 150. More particularly, with developing device 110, photosensitive drum 101, cleaning device 116 and fixing device 128 positioned along path 143 wherein developing device 110 is above photosensitive drum 101, photosensitive drum 101 is above cleaning device 116 and cleaning device 116 is above fixing device 128, collection of excess toner is efficiently and simply achieved and splashing onto other portions of apparatus 100 is substantially eliminated.

Since excess toner 168 does not splash onto other portions of apparatus 100 and is contained within cleaning device 116, soiling of one's hands when removing container 150 from apparatus 100 is minimized.

Cleaning device 116 also includes a scraping device 171 located within container 150 near neck 180 for scraping toner from stack 156. Scraping device 171 includes a cleaning plate 174 having a tip 175, rotatable about a shaft 177 and driven by a motor (not shown). Plate 174 has a length L and is positioned within container 150 so that tip 175 can contact the interior front surface of neck 180. Following removal of toner waste 168 from photo sensitive member 101 by cleaning blade 159, toner waste 168 drops to the lower interior surface of stack 156 near neck 180. Cleaning plate 177 operably rotates in a circular path designated by arrow B scraping toner waste 168 from the interior surface of stack 156 around neck 180. Therefore, any toner waste 168 which may begin to accumulate around the interior surface of neck 180 is pushed into base 153.

Cleaning device 116 further includes a cantilever shaped compression plate 183 made of a resilient material and connected at its proximal end to an inner wall near a rear end 186 of base 153. The distal end of compression plate 183 is normally adjacent to shaft 177. Each time scraping member 171 travels in its circular path B, tip 175 of cleaning plate 174, after passing beyond and below neck 180, contacts compression plate 183. Due to the resiliency of compression plate 183, cleaning plate 174 depresses compression plate 183 a distance equal to its length L. As cleaning plate 174 swings past compression plate 183, compression plate 183 returns to its non-flexed position with its distal end once again adjacent to shaft 177. Consequently, toner waste 168 will be compressed within base 153 whenever its height approaches the top of base 153 by the reciprocating motion of compression plate 183. Compression of toner waste 168 by compression plate 183 of about 1.5 to 1.6 times its weight in its non-compressed state is possible.

Container 150 is formed with an opening 195 in rear wall 186 of base 153 and a bellows-shaped diaphragm 192 is disposed therein. Diaphragm 192 is connected to the interior surface of rear wall 186 and includes a projecting part 198 which is expandable for contacting a microswitch 201.

Figure 3:
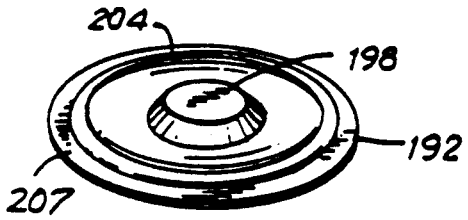
FIG. 3 is a perspective view of a bellows-like diaphragm utilized in the device of FIG. 1.

As shown in FIG. 3, bellows-shaped diaphragm 192 includes an expandable brim 204 surrounded by a skirt 207 and a truncated conical cap 198. Diaphragm 192 is made of a variable thin film elastic material such as silicon rubber and the like which maintains its resilient shape as shown in FIG. 3 except when pressed against by toner waste 168.

The pressure exerted on diaphragm 192 by compressed toner waste 168 causes brim 204 to expand outwardly toward opening 195. As compressed toner waste 168 reaches a predetermined height within base 153, the pressure on diaphragm 192 forces brim 204 to travel a predetermined distance causing cap 198 to press against and electrically close microswitch 201. Closure of microswitch 201 activates an alarm system 202 which alerts a user that container 150 needs to be emptied of toner waste 168. The actual alarm may be either a visual and/or audio signal such as but not limited to a flashing lamp, buzzer and the like. Additionally, upon activating alarm system 202, the copying/printing operation is interrupted to ensure that no additional toner waste 168 is scraped off photosensitive drum 101 which can lead to oozing of toner waste 168 through the top of stack 156.

Figure 4:
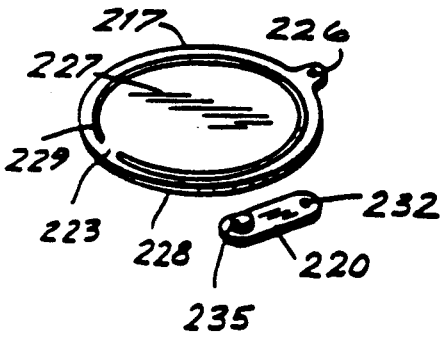
FIG. 4(*a*) is a perspective view of the contact plates of a microswitch in the cleaning device of FIG. 1.
Figure 4:
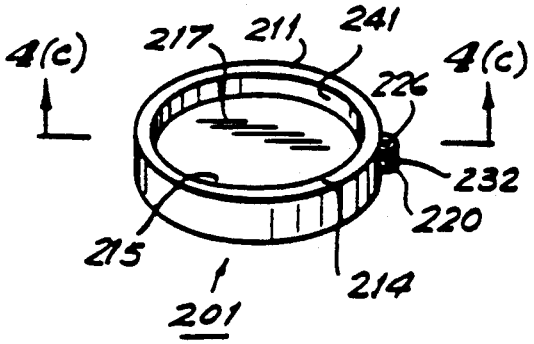
Figure 4:
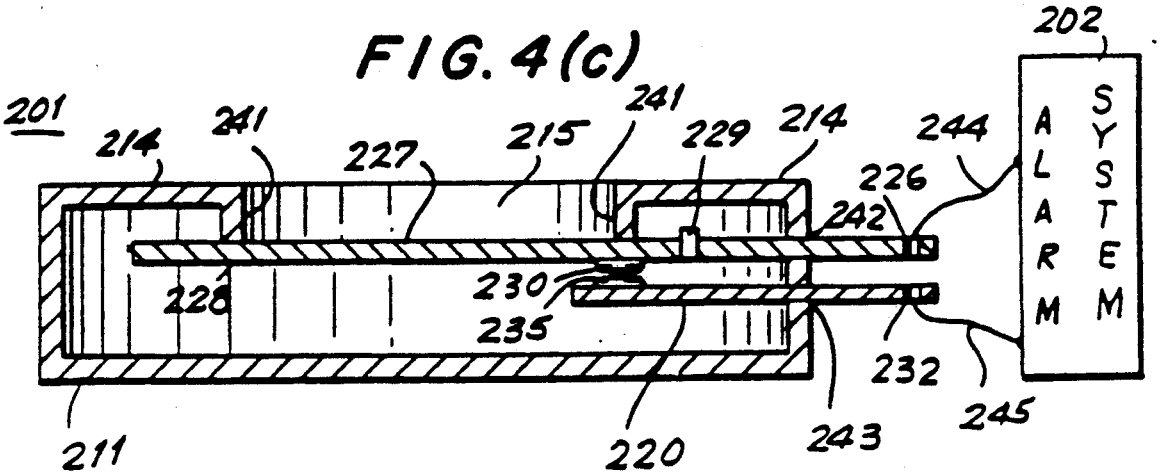

Referring now to FIG. 4(*a*), FIG. 4(*b*) and FIG. 4(*c*), microswitch 201 includes a cylindrical outer shell 211 having a circular inner flange 214 forming an inner opening 215, a first contact plate 217 and a second contact plate 220. Contact plate 217 includes a terminal 226 and a flat circular neck 223 having a front surface 227 and a rear surface 228. Contact plate 217 is made from an electrically conductive, resilient material, such as phosphor bronze and the like. Contact plate 217 also includes a circular rib 229 on front surface 227 and a protrusion 230 on rear surface 228 and distanced slightly inwardly from rib 229. Second contact plate 220 is a substantially flat, elongated oval made of an electrically conductive material and includes a terminal 232 and a protrusion 235.

Flange 214 of shell 211 includes a circular lip 241 extending inwardly toward the interior of shell 211 and has a circumference slightly smaller than the circumference of rib 229. Shell 211 also includes two openings 242 and 243 which are slightly larger than terminals 226 and 232. First and second contact plates 217 and 220 are disposed within the interior of shell 211 with terminals 226 and 232 extending through the openings 242 and 243 of shell 211, respectively. Wires 244 and 245 connect terminals 226 and 232 to alarm system 202, respectively. Neck 223 supports contact plate 217 in a cantilever like manner with front surface 227 in contact with lips 241. Contact plate 217 is prevented from moving about laterally by lips 241 contacting rib 238. Similarly, contact plate 220 is disposed within shell 211 in a cantilever like manner.

Microswitch 201 operates as follows. Before cap 198 of diaphragm 192 presses against front surface 227 of contact plate 217, protrusions 230 and 235 are separated from each other. Therefore, microswitch 201 is in an electrically open state. As cap 198 extends through opening 215 and presses with little force against front surface 227 of contact plate 217, contact plate 217 bends slightly resulting in protrusion 230 contacting protrusion 235. Microswitch 201 is now in an electrically conductive state and activates alarm system 202.

Figure 5:
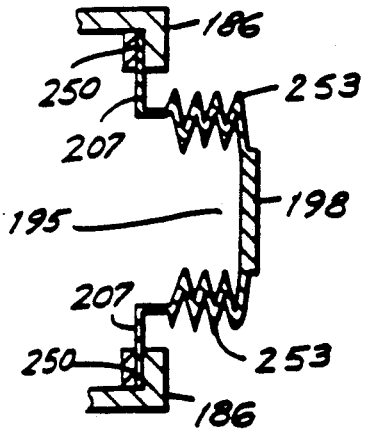
FIG. 5(*a*), FIG. 5(*b*), FIG. 5(*c*) and FIG. 5(*d*) are cross-sectional views of the bellows-like diaphragm for use in accordance with alternative embodiments of the invention.
Figure 5:
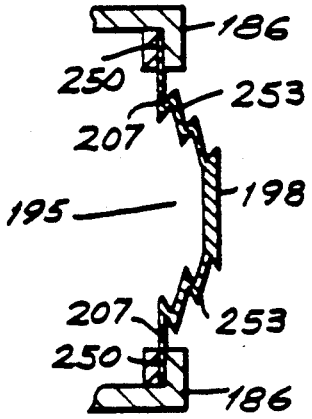
Figure 5:
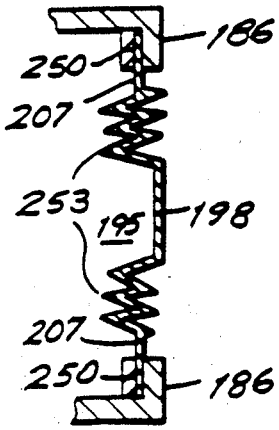
Figure 5:
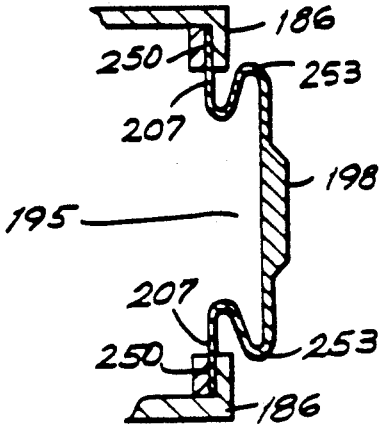

FIGS. 5(*a*)–(*d*) illustrate a number of alternative embodiments of baffle shaped diaphragm 192 in which skirt 207 is secured to rear wall 186 within a circular groove 250 surrounding the perimeter of opening 195. Additionally, brim 204 includes pleats 253 which always expand outwardly beyond opening 195 towards microswitch 201. FIGS. 5(*a*) and (*b*) show pleats 253 which upon expansion assume a cylindrical and truncated conical shape, respectively. In both FIGS. 5(*a*) and 5(*b*) pleats 253 prior to expansion are beyond skirt 207 projecting outwardly toward opening 195. In FIG. 5(*c*), however, pleats 253 prior to expansion are substantially in line with skirt 207 as also shown in FIG. 3. FIG. 5(*d*) includes pleats 253 which in their unexpanded state overlap skirt 207 and extend beyond opening 195.

Figure 6:
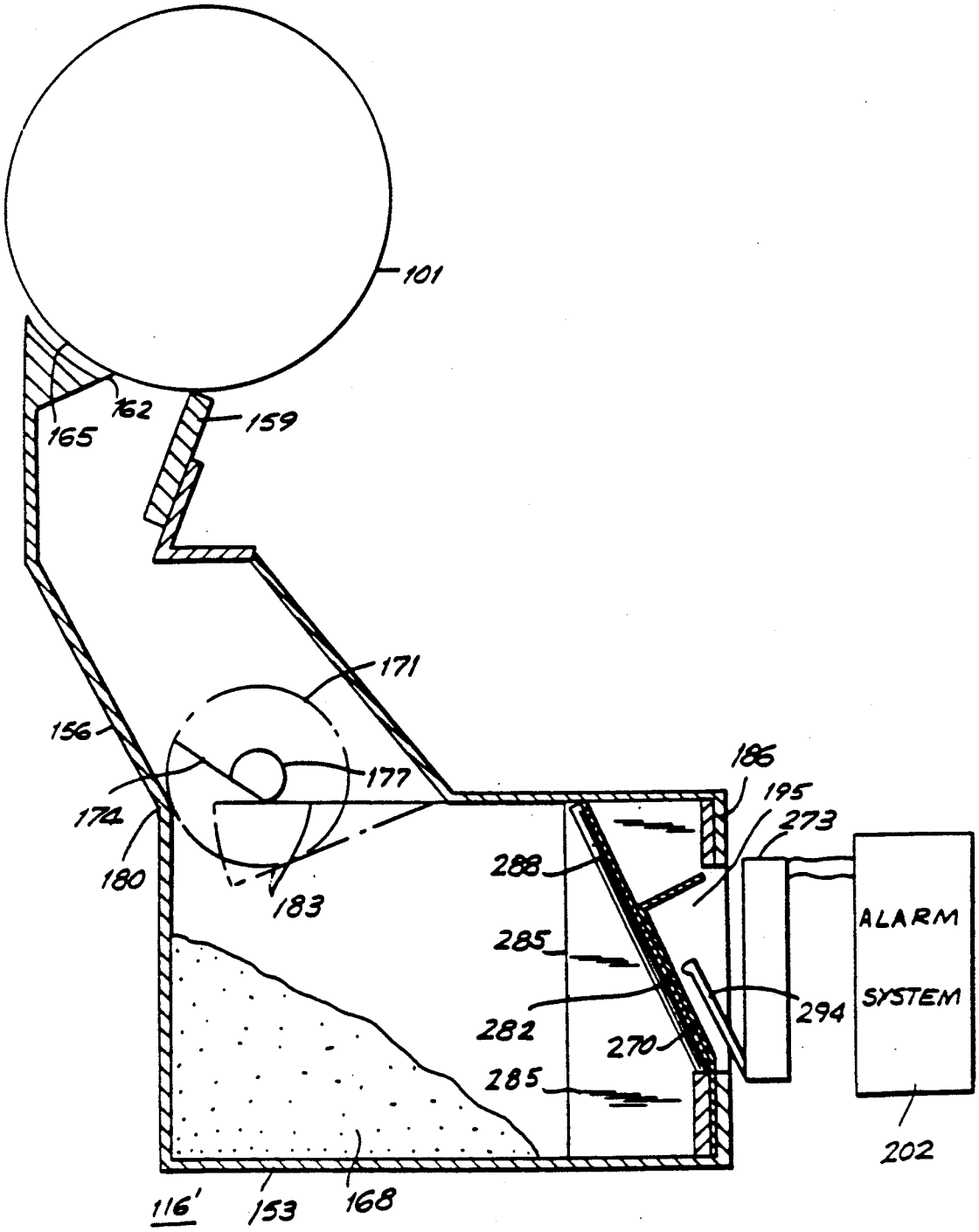
FIG. 6 is a side elevational view in cross-section of a cleaning device in accordance with an alternative embodiment of the invention.

As shown in FIG. 6, an alternative cleaning device 116' similar to cleaning device 116 (with the same elements denoted by like reference numerals) includes a rectangular diaphragm 270 and a leaf switch 273 rather than bellows shaped diaphragm 198 and microswitch 201, respectively.

Figure 7A:
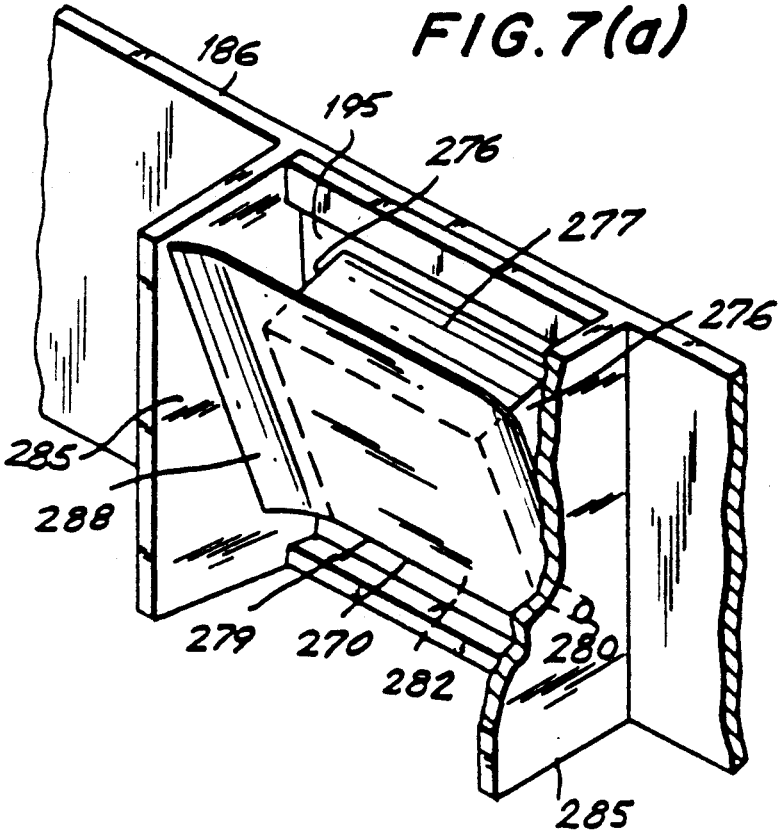
FIG. 7(*a*) and FIG. 7(*b*) are fragmentary perspective views of the diaphragm region of containers in accordance with an alternative embodiment of the invention.
Figure 7B:
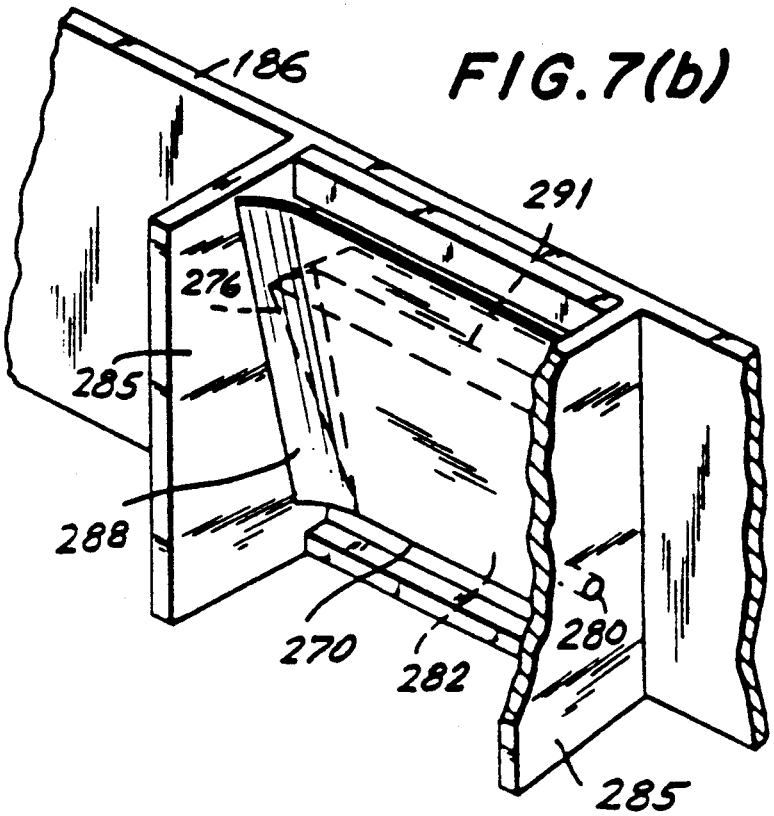

A first embodiment of rectangular diaphragm 270 is shown in FIG. 7(*a*) and FIG. 7(*b*). Diaphragm 270 is an open ended, upside down rectangular pyramid and includes sides 276, base 277 and a front face 282. Sides 276 and base 277 are made from a thin film elastic material such as silicon rubber and the like. Front face 282 is also made from the same elastic material but is somewhat thicker than sides 276 and base 277 to create a stiffer surface for toner waste 1 168 to press against. Alternatively, front face 282 can be of the same thickness as sides 276 and base 277. A stiff thin plate made of phosphor bronze and the like would then be affixed to front face 282 to provide the necessary stiffness. In its non-flexed position, the resiliency of sides 276 and base 277 allow diaphragm 270 to maintain the shape shown in FIG. 7(*a*).

A pair of bulkhead plates 285 are connected to the interior surface of rear wall 186 surrounding opening 195 in order to direct and thereby concentrate the force of toner waste on face 282 rather than sides 276. Diaphragm 270 is rotatably connected by a shaft 280 at its bottom to bulkhead plates 285. Additionally, a thin film layer 288 is integrally connected to face 282 to prevent toner waste 168 from oozing between front face 282 and bulkhead plates 285.

As toner waste 168 begins to accumulate within base 153 and is further compressed by compression plate 183, the compressed toner waste exerts pressure on face 282. Front face 282 under the mounting pressure by the compressed toner waste 168, pushes against sides 276 and base 277 which begin to buckle as shown by dash lines 291 in FIG. 7(*b*). Consequently, front face 282 begins to pivot about shaft 280 toward opening 195.

Referring once again to FIG. 6, leaf switch 273, which is connected to the interior of image forming apparatus 100, is positioned so that an arm 294 thereof is located a predetermined distance from face 282 prior to sides 276 and base 277 buckling. Upon face 282 moving this predetermined distance toward arm 294, leaf switch 273 will activate alarm system 202 and thereby notify a user that base 153 needs to be emptied of toner waste 168. At the same time all printing/copying will be interrupted to ensure that no toner waste oozes from stack 156.

Figure 8:
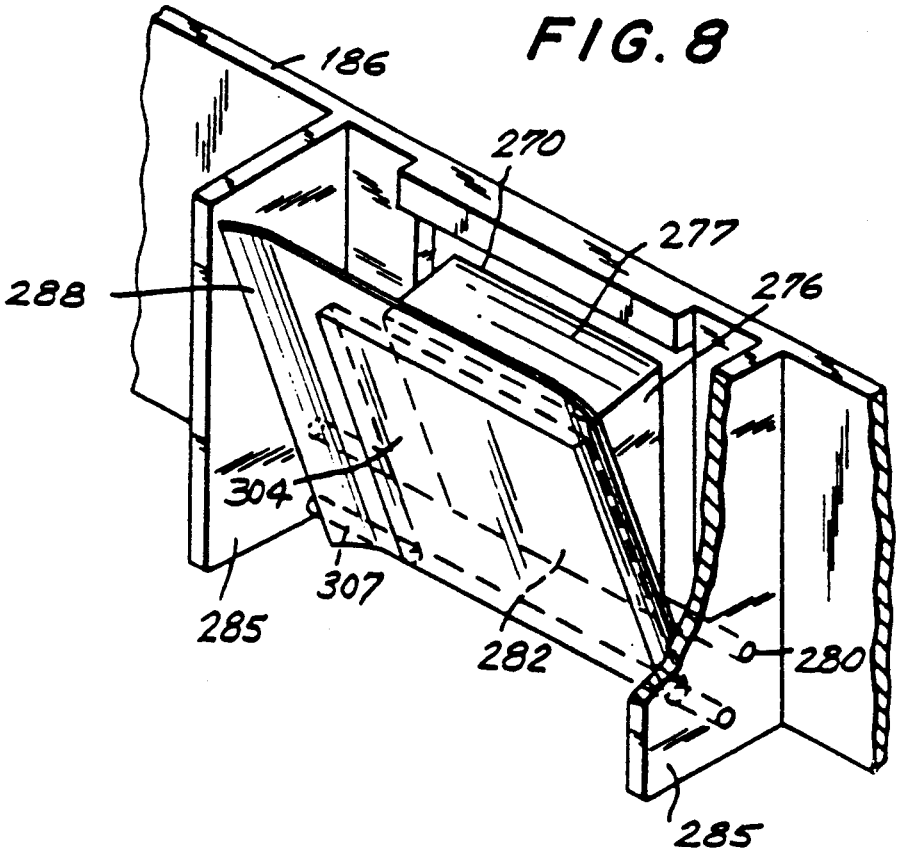
FIG. 8 is a fragmentary perspective view of the diaphragm in accordance with yet another alternative embodiment of the invention.

Another type of rectangular diaphragm is illustrated in FIG. 8 which is similar to rectangular diaphragm 270 of FIG. 7(*a*) and FIG. 7(*b*). In FIG. 8, a pressure plate 304 rotatably connected to the bottom of bulkhead plates 285 by a shaft 307 is positioned parallel to and slightly spaced apart from plate 282 with walls 276 and base 277 in their unbuckled state. The major axes of shaft 307 and shaft 280 are substantially parallel to each other. Pressure plate 304 is made from a hard film such as, but not limited to, resin, metal and the like. Layer 288 is connected integrally to pressure plate 304. Similar to FIG. 7, when toner waste 168 exerts pressure against pressure plate 304, sides 276 and base 277 buckle resulting in pressure plate 304 pushing face 282 sufficiently forward to move arm 294 of leaf switch 273 a predetermined distance to activate alarm system 202.

Figure 9:
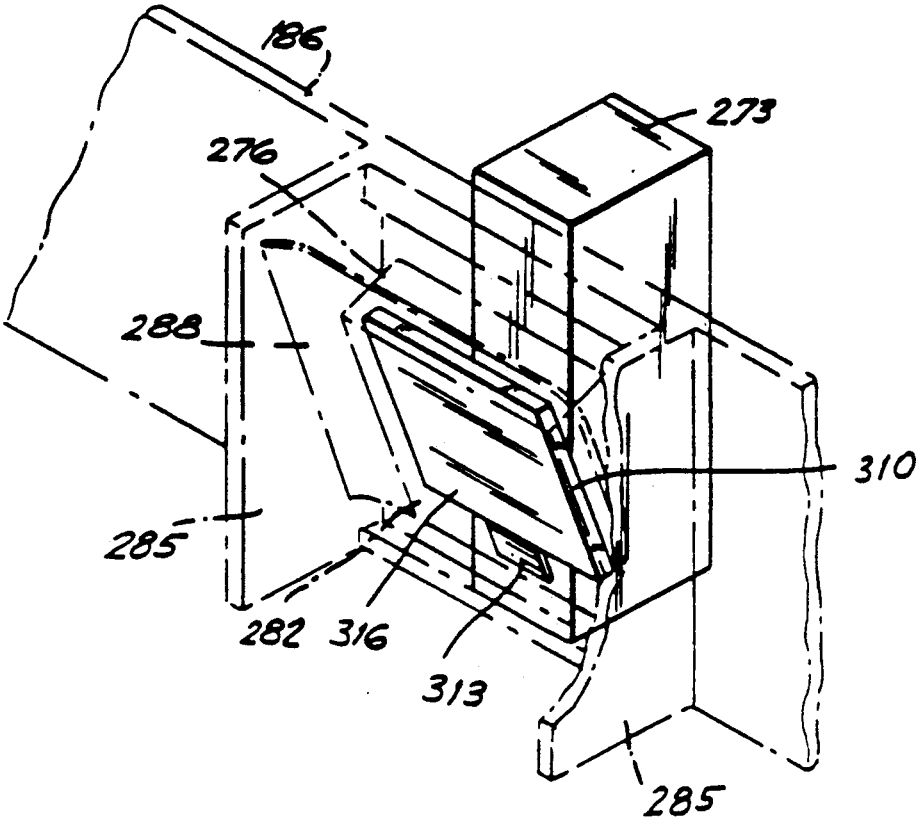
FIG. 9 is a fragmentary perspective view of the container and a leaf switch assembly in accordance with still another alternative embodiment of the invention.

In FIG. 9 diaphragm 270, bulkhead 285 and rear wall 186 are denoted by phantom lines and a hinge 310 is used to circumvent the need for face 282 to be more rigid than surfaces 276 and base 277. Hinge 310 includes a leg 313 which is secured to leaf spring 273 at its distal end and a plate 316. Plate 316 is substantially parallel and next adjacent to face 282 of diaphragm 270 and is made from a hard film such as resin, metal and the like. When pressure begins to mount on face 282 by the build up of toner waste 168 in base 153, sides 276 and base 277 begin to buckle. Plate 316 which is positioned relatively close to face 282 begins to pivot toward opening 195 and plate 316 is urged towards leaf switch 273. After plate 316 moves a predetermined distance, plate 316 forces leaf switch 273 to switch to its electrically closed state and thereby activates alarm system 202.

Of course, the actual shape of diaphragms 196 and 270 and switches 201 and 273 are not limited to the embodiments and materials shown and described herein. For example, other methods for detecting the level of toner waste within base 153 other than a diaphragm such as, but not limited to, employing piezoelectric elements, photointerruptors and proximity switching can be used.

In view of the foregoing, it can now be readily appreciated that cleaning device 116 prevents oozing and splattering of toner waste, reliably alerts a user as to the need for emptying the toner from container 150, and reduces the size of container 150 waste compared to the prior art.

Figure 10:
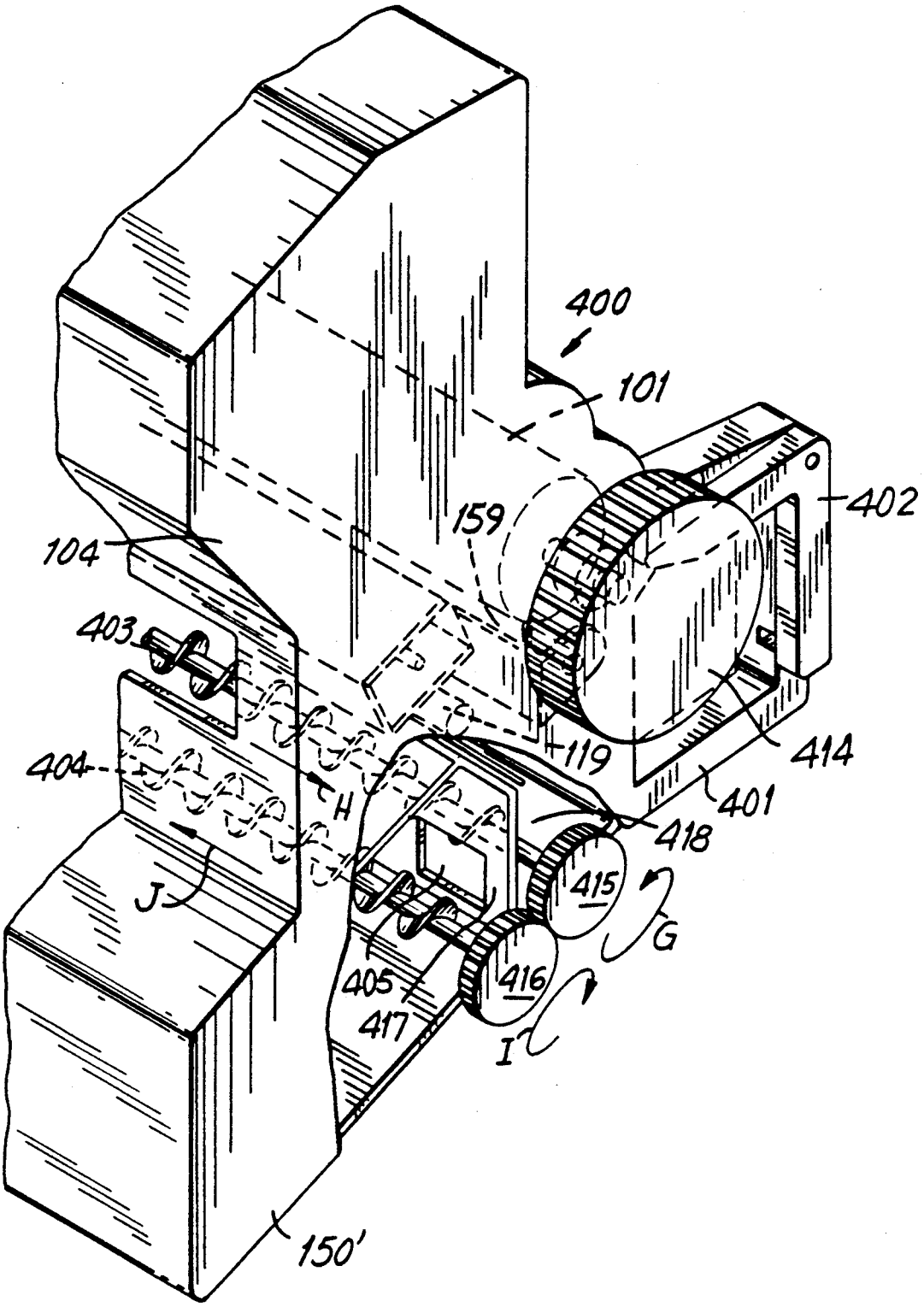
FIG. 10 is a fragmentary perspective view of the process unit in accordance with the invention showing the developing unit, the cleaning device with spiral carrier screws, a photosensitive drum, charging plate, erasing lamp, and one of two handles which allow the unit to be easily attached and detached.
Figure 11:
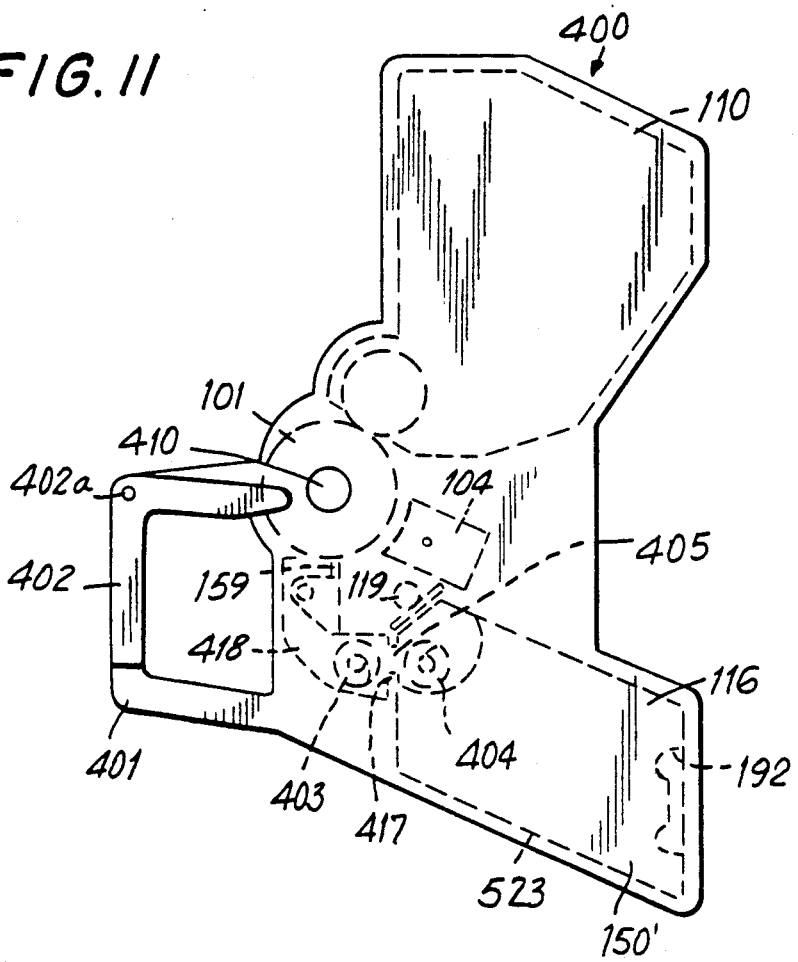
FIG. 11 is a side elevational view of the process unit of FIG. 10.
Figure 13:
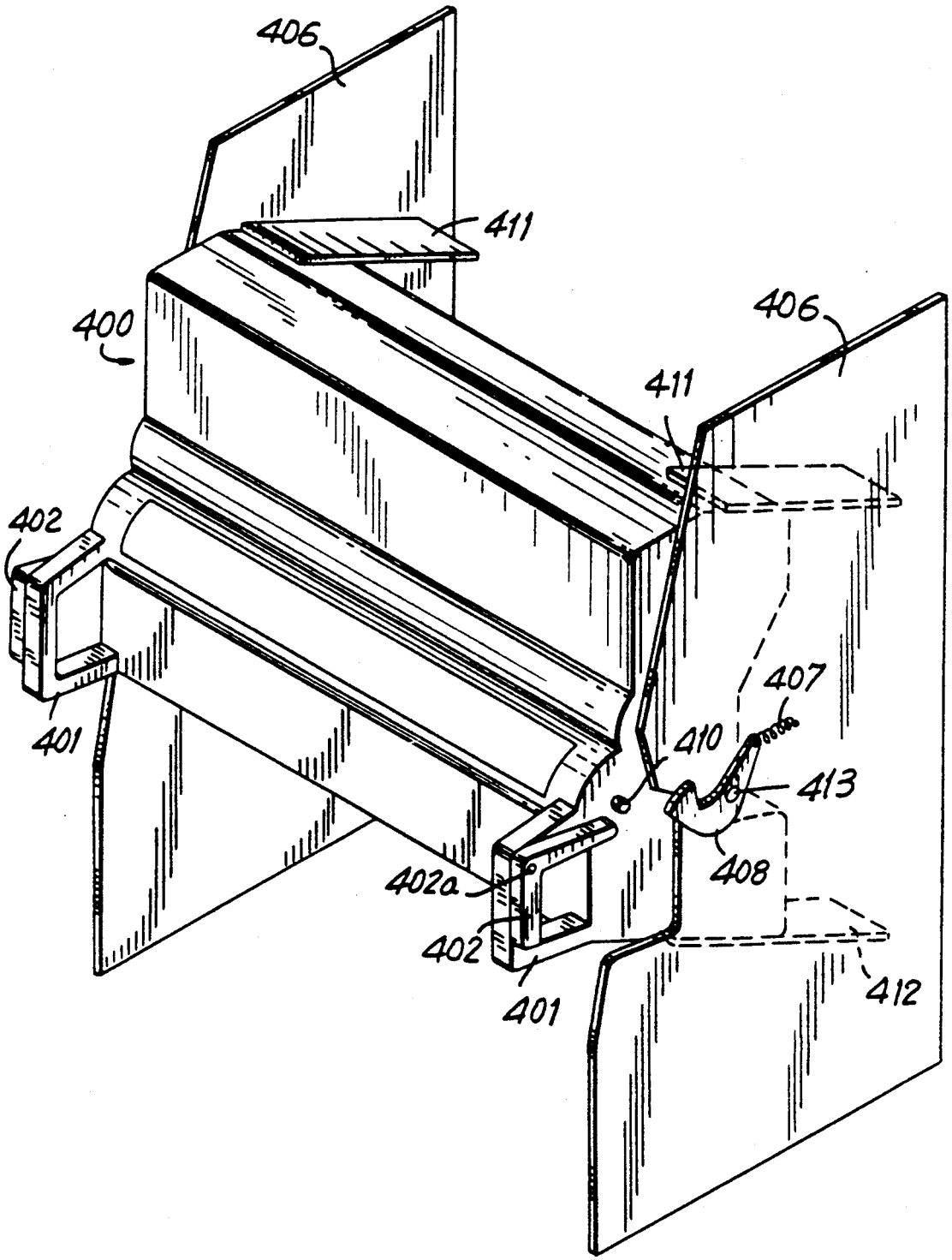
FIG. 13 is a perspective view of the process unit of FIG. 10 showing both handles and top and bottom guide plates.

Referring to FIG. 10 and FIG. 11, a process unit 400 includes a photosensitive drum 101, charging device 104, erasing lamp 119, developing device 110 and cleaning unit 150'. As more particularly shown in FIG. 13, the complete process unit is formed as a unitary cassette with a pair of rectangular handles 401 and levers 402 for detaching the unit from the body of an image forming apparatus. Support plates 406 and guide plates 411 and 412 on the body of the image forming apparatus insure accurate alignment of the cassette and proper engagement with the locking hooks 408.

Figure 15:
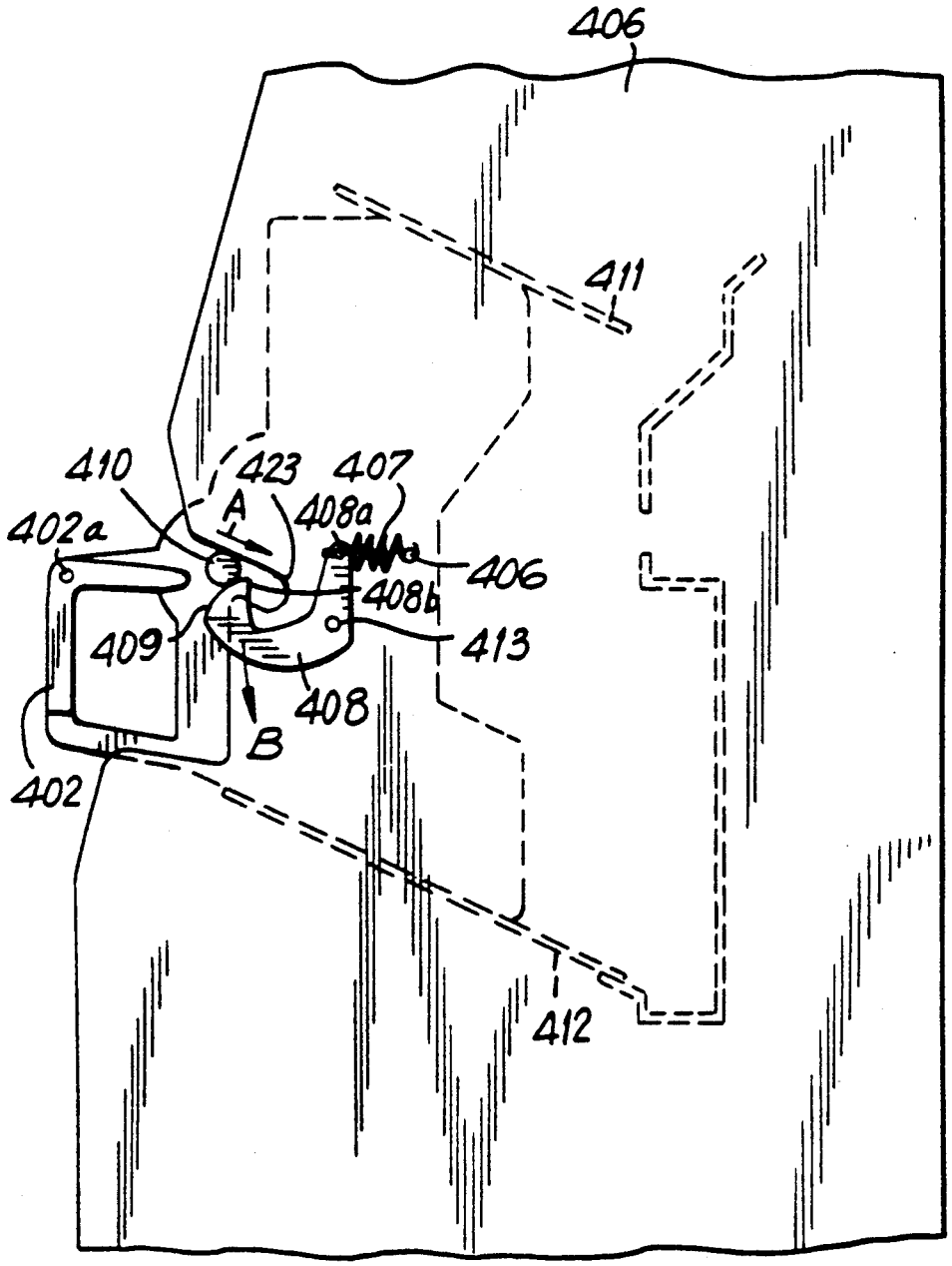
FIGS. 15, 16 and FIG. 17, are fragmentary side elevational views of the process unit in accordance with the invention at various stages of being attached to and detached from an image forming apparatus.
Figure 16:
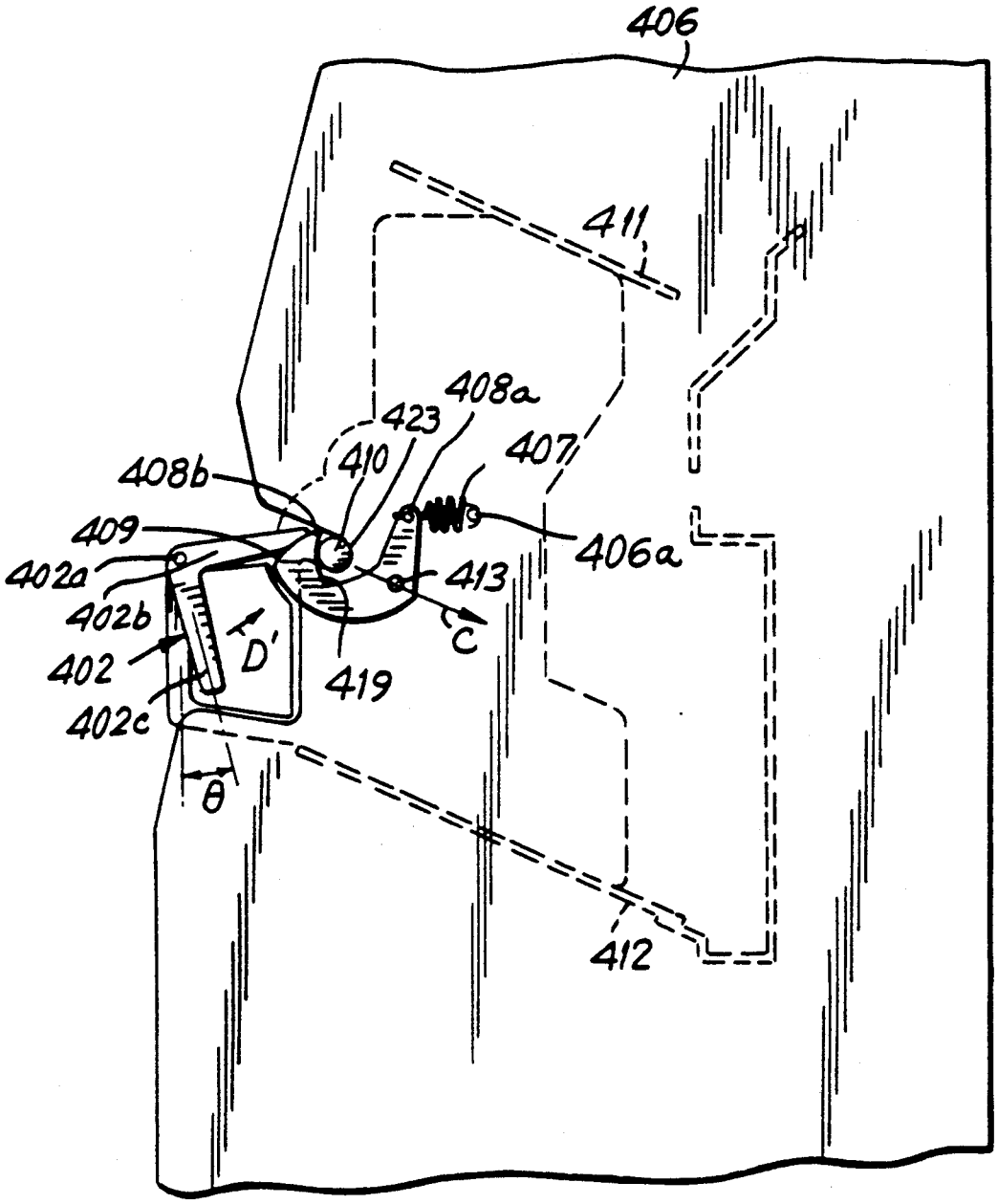

FIG. 15 and FIG. 16 show the cassette 400 being attached to the image forming apparatus. A handle 401 is provided on each side of the cassette by which the cassette is manually manipulated to put it into place. One locking lever 402 is anchored to the upper outside corner of each rectangular handle through a shaft 402*a* which allows the lever to pivot. The cassette is properly guided into position by two pairs of vertically spaced guide plates 411 and 412. Each pair of guide plates is fixed at an incline in the direction of arrow A in FIG. 15 on one of two spaced support plates 406. As the cassette slides forward, the projecting bearing 410 of the rotational shaft of the photosensitive drum 101 makes contact with the sliding surface 409 of hook 408. A hook 408 is pivotably mounted on each plate 406 by a pivot 413. A coil spring 407 mounted between pin 408*a* of hook 408 biases hook 408 in the clockwise direction as viewed in FIG. 15. At the position shown in FIG. 15, to which hook 408 is biased by spring 407, the end 408*b*of hook 408 is in and closes the end region of a notch 423 in support plate 406. Each bearing 410 is received and retained in a notch 423 in a support plate 406.

As the cassette continues to slide forward in notch 423, the hook 408 begins to pivot against the bias force of spring 407 in the direction of arrow B of FIG. 15. Finally, the bearing 410 loses contact with the sliding surface 409, passes end 408*b* of hook 408 and makes contact with the engaging surface 419 on hook 408 as shown in FIG. 16. The bias force of the lever spring 407 causes the engaging surface 419 of hook 408 to exert a force in the direction of arrow C on bearing 410. This force fixes bearing 410 to the end portion of the notch 423 and holds the cassette securely in its proper position. Specifically, the cassette is held between support plates 406 and guide plates 411, 412 by the engagement of bearings 410 in notches 423 by hooks 408 and springs 407.

Figure 17:
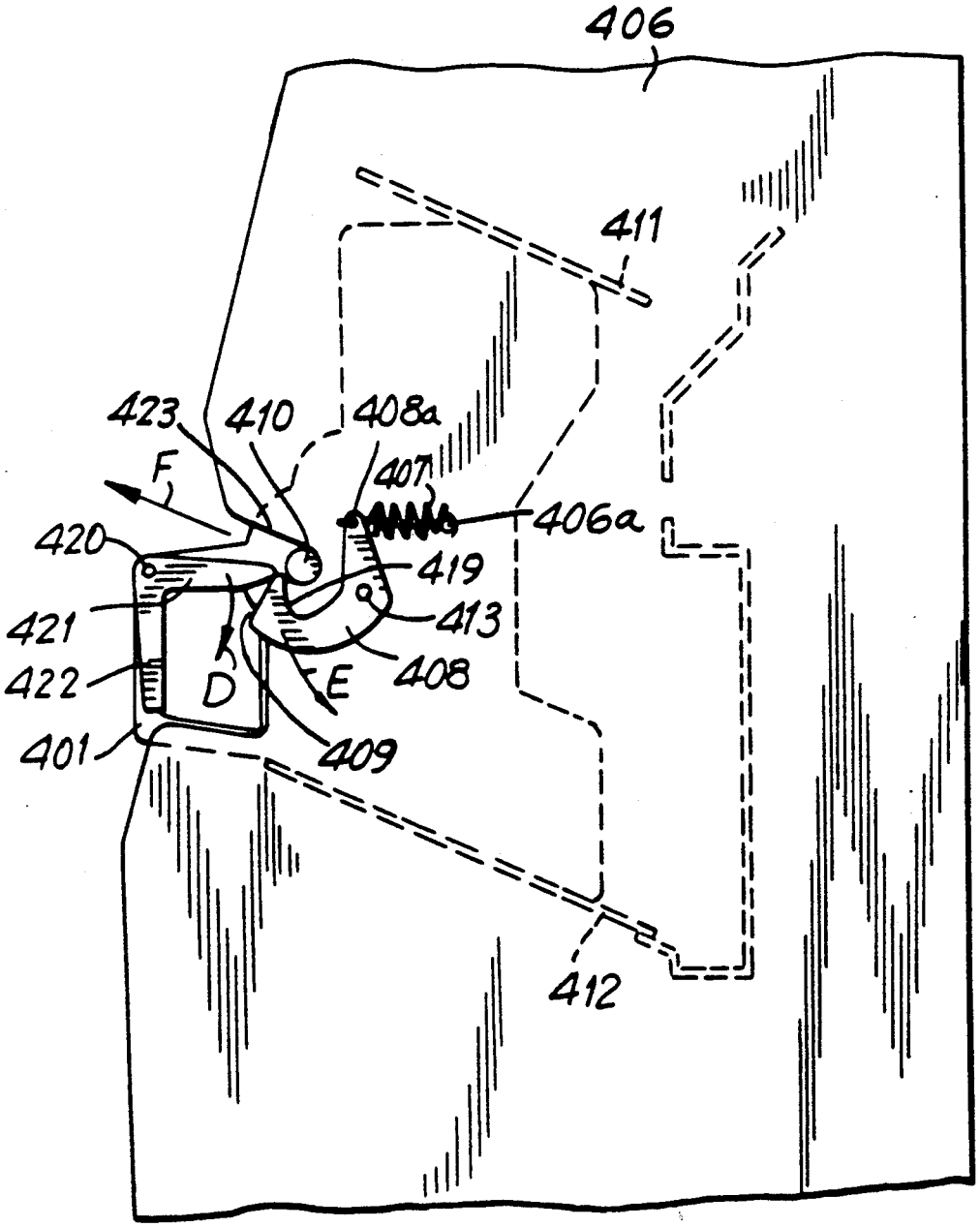

As the unitary cassette is engaged, the horizontal arm 402*b* of lever 402 engages against sliding surface 409 of hook 408 to pivot the lever 402 in the direction of arrow D' as shown in FIG. 16. At this position, an angle 8 is formed between the vertical portion 401 of the rectangular handle 401 and the vertical arm 402*c* of lever 402. In the fully engaged position of FIG. 16, the distal end of the horizontal arm of the lever rests on the sliding surface 409 of hook 408 as shown in FIG. 16. To remove the unitary cassette, vertical arm 402*c* of lever 402 is engaged and the lever 402 is pivoted in the direction of arrow D of FIG. 17 about anchoring shaft 402*a* so that the angle Θ is reduced to zero. As the angle is reduced, the end 402*b* of the lever 402 contacting the sliding surface 409 of hook 408 acts against the bias force of the spring 407 and pushes the hook downward in the direction E as shown in FIG. 17. At a point where the angle 8 is nearly zero, contact between the bearing 410 and engaging surface 419 is lost as shown in FIG. 17. The cassette is now disengaged and may be pulled out along notch 423 in the direction of arrow F as shown in FIG. 17.

The cleaning unit of the unitary cassette comprises a pair of spiral carriers as shown in FIG. 10 to transport and compress the toner waste. As residual toner is scraped off the photosensitive drum 101 by cleaning blade 159 it drops into preliminary chamber 418 where the first spiral carrier 403 is located. Spiral carrier 403 is rotated in the direction G by a rotatable driving means (not shown) which engages driving gear 415 coupled to spiral carrier 403 and causes the waste toner in the chamber to be transported in the direction of arrow H. Transport opening 405 within partition wall 417 allows the transported toner to leak into the toner waste container 150. On the opposite side of partition wall 417 and within the toner waste container 150', a second spiral carrier 404 is rotatably mounted. Spiral carrier 404 is coupled to second driving gear 416 which is coupled to and receives its driving force directly from driving gear 415 of spiral carrier 403. This causes second spiral carrier 404 to rotate in a direction I opposite that of spiral carrier 403. As a result, toner waste leaking into the toner waste container 150' through opening 405 is transported in the direction of arrow J by spiral carrier 404 as shown in FIG. 10. Thus, the second spiral carrier 404 transports toner waste in a direction opposite that of the first spiral carrier 403.

Figure 12:
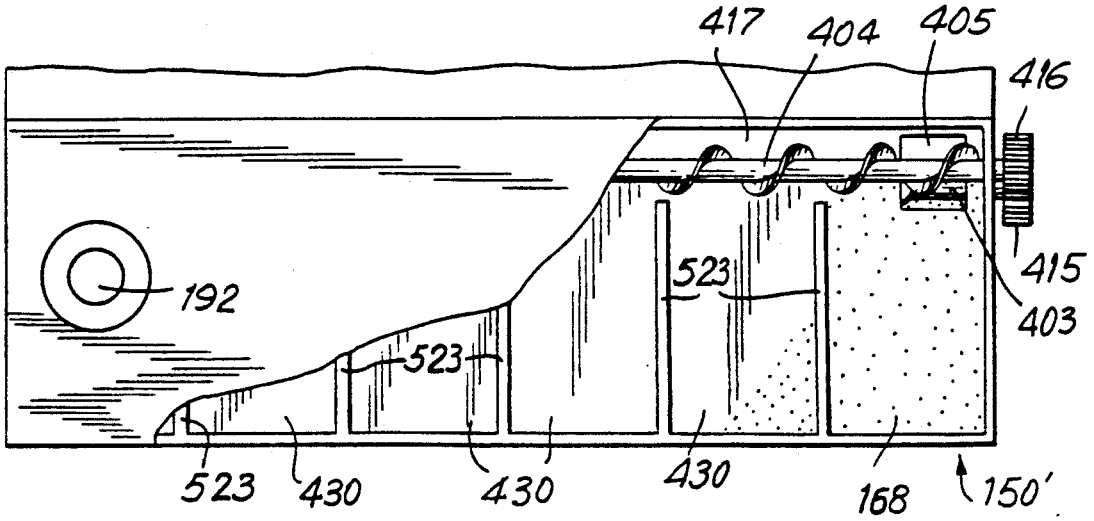
FIG. 12 is an enlarged fragmentary front elevational view of the toner waste container of the process unit of FIG. 10.

As more particularly shown in FIG. 12, waste container is formed with a plurality of partitions or movement plates spaced along the length of second spiral carrier 404 to define a series of compartments 430 leading from opening 405 to diaphragm 192. The opening 405 is in registration with the first of compartments 430 while the diaphragm is in the last compartment. As each compartment 430 is filled, second spiral carrier 404 carries the waste toner 168 to the next compartment, to fill that compartment. When the last compartment reaches a predetermined level, the diaphragm 192 is deflected, actuating a microswitch as described above.

The combined action of both spiral carriers insures that efficient use of the volumetric capacity of the waste container will be made by making the distribution of waste within the container independent of the photosensitive drum's printing pattern. As first spiral carrier 403 collects the toner waste, second spiral carrier 404 insures that the waste container is gradually filled starting from the side of the opening 405 and moving in a longitudinal direction parallel to the spiral carriers. When the container 150' is full, the diaphragm 192 thereby activates an alarm.

Figure 14:
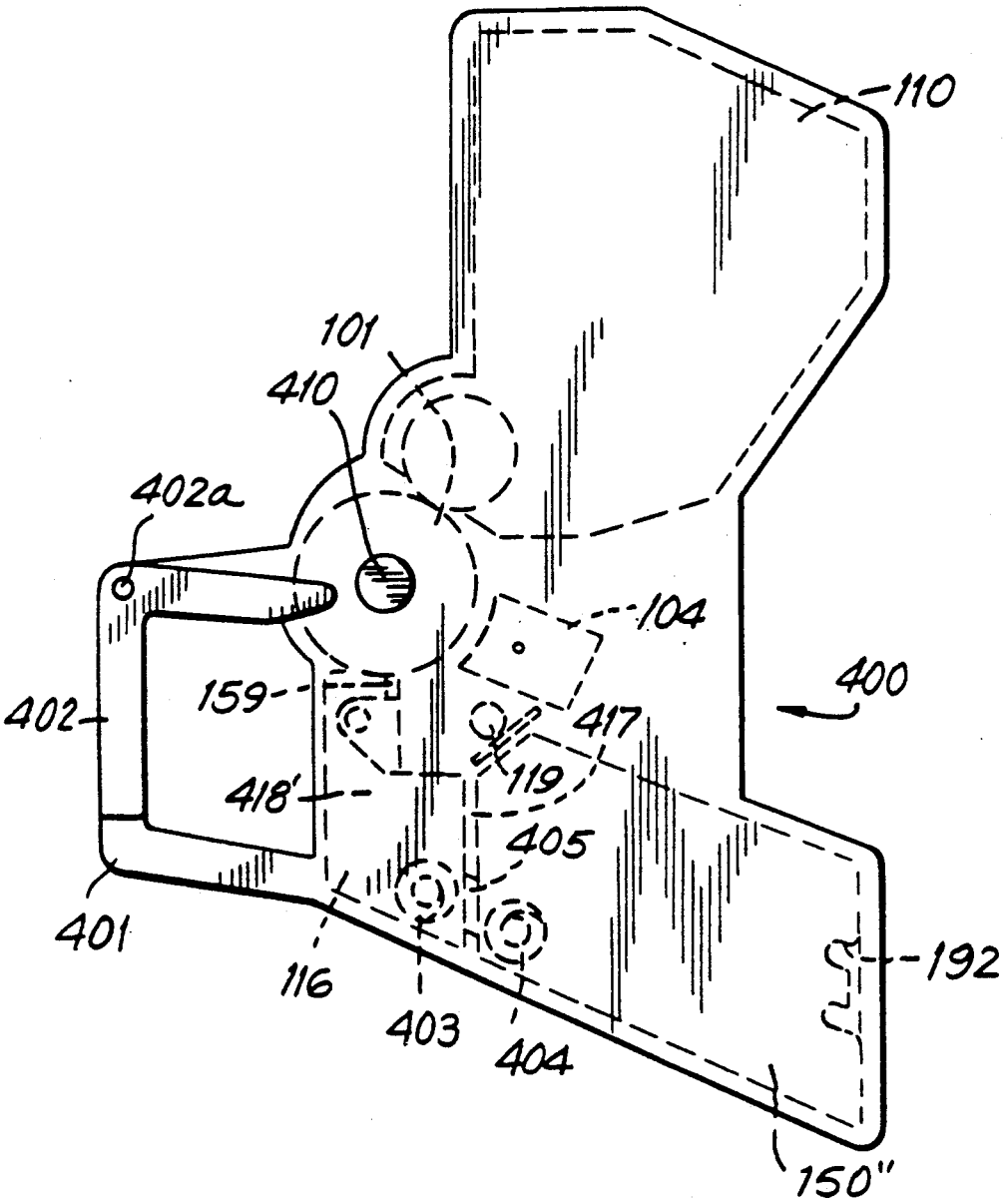
FIG. 14 is a side elevational view of an alternative embodiment of the process unit in accordance with the invention.

FIG. 14 shows an alternative embodiment of the toner waste container 150''. In the embodiment shown in FIG. 14, the spiral carriers 403 and 404, respectively, are located along the inclined bottom surface of preliminary chamber 418' and toner waste container 150''. On the other hand, in the embodiment shown in FIGS. 11 and 12, the spiral carriers are located along the upper surface of the preliminary chamber 418 and toner waste container 150'. Locating the spiral carrier along the upper surface allows the provision of the plurality of partitions or movement control plates 523 to be located longitudinally within the toner waste container 150. As noted above, the movement control plates 523 partition the toner waste container 150' into small compartments which are then filled individually with toner waste. Because the toner waste 168 resides securely within each compartment, the process unit may be handled without inadvertently shifting the toner waste 168 to one side. This prevents the alarm from erroneously signaling the user to replace the process unit 400 before the toner waste container 150' is full and allows sufficient use of the volumetric capacity of the container. Furthermore, because the amount of toner waste 168 which overflows from each compartment and is carried to the next compartment is small, the mechanical load on the spiral carrier 404 is small. This has the effect of eliminating torque variations on spiral carriers 403 and 404.

The provision of a cartridge including the developing unit, photosensitive drum and cleaning unit further insures the positioning accuracy of these elements relative to each other. Further, an unskilled user can effect replacement of the cassette, avoiding the need to wait for a skilled repair person, leaving the device unusable in the interim. In alternative embodiments, only two of the developing unit, photosensitive drum and cleaning unit can be mounted in the cartridge. While the embodiment of the invention depicted uses a photosensitive drum, any other photosensitive member may be utilized.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An apparatus for forming an image on a recording medium by transferring toner from an image carrier to the recording medium, comprising:

a photosensitive member serving as the image carrier;

developing means, which include toner, for developing an image represented by the toner on the photosensitive member;

transfer means for transferring toner deposited on the photosensitive member to the recording medium whereby the image is formed on the recording medium;

cleaning means for removing and storing excess toner which is not transferred from the photosensitive member to the recording medium;

the transfer means and photosensitive member each having a bottom portion, the bottom portion of the transfer means being positioned substantially above the bottom portion of the photosensitive member and the cleaning means being disposed substantially facing the bottom of the photosensitive member;

cartridge means including at least one handle means and at least two of the photosensitive member, cleaning means and developing means; and mounting means for releasably mounting said cartridge means on said apparatus and including at least one latch means for releasably retaining said cartridge means on said apparatus;

wherein said cartridge means further includes at least one projection extending laterally therefrom and said mounting means further includes at least one support plate formed with a notch for receiving said projection and said latch means being adapted to releasably retain said projection in said notch;

wherein said latch means includes a hook pivotably mounted on said support plate and displaceable between a latch position at which said hook can retain said projection in said notch and an open position at which said projection can pass by said hook, and spring means for biasing said hook to said latch position; and wherein said hook is formed with a camming surface on the end thereof facing the entrance of the notch and shaped so that engagement of the projection against said camming surface pivotably displaces said hook from its latch position to its open position to permit passage of the projection into the notch, the hook returning to its latch position upon such passage; and further including lever means having first and second arms and being pivotably mounted on said handle means, said first arm being engaged by the end of said hook upon insertion of said projection into said notch to pivot said lever means in a first direction to a position at which said second arm of said lever means is out of registration with said handle means, the manual displacement of said second arm of said lever means into registration with said handle means displacing said hook to its open position to permit removal of said cartridge means.

2. The apparatus of claim 1, and including at least two said handle means, latch means and lever means.

* * * * *